US006265974B1

(12) United States Patent
D'Angelo et al.

(10) Patent No.: US 6,265,974 B1
(45) **Date of Patent: *Jul. 24, 2001**

(54) SYSTEMS AND METHODS FOR MONITORING SPATIAL RELATIONSHIP BETWEEN MOBILE OBJECTS

(75) Inventors: Michael R. D'Angelo, Melrose, MA (US); Geoffrey M. Eggert, Cape Elizabeth, ME (US); Joseph E. Qualitz, Stow; Robert G. Bresler, Newton, both of MA (US)

(73) Assignee: Lexent Technologies, Inc., Lexington, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/364,726

(22) Filed: Jul. 30, 1999

Related U.S. Application Data

(63) Continuation-in-part of application No. 09/099,815, filed on Jun. 19, 1998, now Pat. No. 6,133,830, and a continuation-in-part of application No. 09/129,008, filed on Aug. 4, 1998, now Pat. No. 5,963,131.

(51) Int. Cl.[7] ..... G08B 13/14

(52) U.S. Cl. ..... 340/568.1; 340/328; 340/571; 340/686.6

(58) Field of Search ..... 340/568.1, 571, 340/572.1, 573.4, 686.6, 539, 529, 328, 502, 505, 10.1

(56) References Cited

U.S. PATENT DOCUMENTS

| | | | | |
|---|---|---|---|---|
| 4,591,835 | | 5/1986 | Sharp | 340/574 |
| 4,598,272 | | 7/1986 | Cox | 340/539 |
| 4,772,879 | | 9/1988 | Hein | 340/571 |
| 5,001,460 | | 3/1991 | Basson | 340/571 |
| 5,001,461 | * | 3/1991 | Vroom et al. | 340/571 X |
| 5,043,702 | | 8/1991 | Kuo | 340/539 |
| 5,126,719 | | 6/1992 | DeSorbo | 340/571 |
| 5,196,825 | * | 3/1993 | Young | 340/573.4 X |
| 5,223,815 | | 6/1993 | Rosenthal et al. | 340/539 |
| 5,260,689 | | 11/1993 | Meyers et al. | 340/568.6 |
| 5,298,883 | * | 3/1994 | Pilney et al. | 340/686.6 X |
| 5,317,304 | | 5/1994 | Choi | 340/571 |
| 5,406,261 | * | 4/1995 | Glenn | 340/571 |
| 5,510,768 | | 4/1996 | Mann | 340/571 |
| 5,552,773 | * | 9/1996 | Kuhnert | 340/686.6 X |
| 5,578,991 | * | 11/1996 | Scholder | 340/571 |
| 5,583,488 | | 12/1996 | Sala et al. | 340/568.1 |
| 5,621,388 | * | 4/1997 | Sherburne et al. | 340/573.4 |
| 5,652,569 | * | 7/1997 | Gerstenberger et al. | 340/573.4 |
| 5,689,240 | * | 11/1997 | Traxler | 340/573.4 |
| 5,721,532 | | 2/1998 | Lehmann et al. | 340/571 |
| 5,748,083 | * | 5/1998 | Rietkerk | 340/571 X |
| 5,748,084 | * | 5/1998 | Isikoff | 340/571 X |
| 5,748,087 | * | 5/1998 | Ingargiola et al. | 340/686.6 X |
| 5,757,270 | | 5/1998 | Mori | 340/568.1 |
| 5,757,271 | | 5/1998 | Andrews | 324/568.1 |
| 5,760,690 | | 6/1998 | French | 340/571 |
| 5,781,109 | * | 7/1998 | Nakajima | 340/568.7 X |
| 5,963,131 | * | 10/1999 | D'Angelo et al. | 340/568.1 |

FOREIGN PATENT DOCUMENTS

| | | |
|---|---|---|
| 2 300 508 | 11/1996 | (GB) . |
| 2 316 212 | 2/1998 | (GB) . |

* cited by examiner

*Primary Examiner*—Thomas Mullen
(74) *Attorney, Agent, or Firm*—Foley, Hoag & Eliot LLP

(57) ABSTRACT

A motion and proximity sensitive system for monitoring spatial relationship between mobile objects comprising two way communication between a Child Unit, affixed to the child, and a Parent Unit, carried by the parent or guardian, is disclosed. When the Child Unit senses motion and determines that it is beyond a set near field proximity to the Parent Unit, the Child Unit communicates alerts to the Parent Unit allowing the parent to trigger an alarm on the Child Unit. A second alarm function selected by the mode switch sounds an alarm automatically in response to motion beyond the set near field proximity according to an adaptive alarm sequence.

29 Claims, 4 Drawing Sheets

SYSTEMS AND METHODS FOR MONITORING SPATIAL RELATIONSHIP BETWEEN MOBILE OBJECTS

RELATED U.S. APPLICATION(S)

The present application is a continuation-in-part of U.S. application Ser. No. 09/099,815, filed Jun. 19, 1998, now issued as U.S. Pat. No. 6,133,830, and Ser. No. 09/129,008, filed Aug. 4, 1998, now issued as U.S. Pat. No. 5,963,131, both of which are hereby incorporated herein by reference.

TECHNICAL FIELD

This invention relates to systems and methods for monitoring mobile objects, and more particularly, to remotely controlled motion and proximity sensitive systems for monitoring spatial relationship between a monitored person, such as a child, and a monitoring person, such as a parent.

BACKGROUND ART

The unintentional separation of a child from a parent, and worse, the outright abduction of a child has been a serious and increasing problem in the U.S. as well as abroad. It has been noted that abduction occurs more often than not in situations wherein the child is in the immediate proximity of a parent. However, because the parent may be otherwise preoccupied, distracted, or has a momentary lapse in attention directed to the child, the child is permitted to stray away from the parent. Common scenarios involve the parent and child walking through a department store, a crowded mall or amusement park. In a moment of inattention by the parent, as he or she may be focusing on a particular item in a store, a display or locating a particular ride or facility, the child may accidentally wander away and becomes abducted. Another scenario may involve a child, in an attempt to explore his surroundings during an activity, such as bike riding or hiking, proceeding far more ahead of the parent than normally permitted. These are but a few examples. However, with the lifestyle of many young families becoming more and more active, the potential for abduction greatly increases.

Approaches to parent-child security have varied in detail ranging from mechanical tethers or physical restraints, similar to a pet leash, to different combinations of separation detectors and signaling devices for remote control and alarm devices. For example, one existing system includes a harness, to be placed on the child, and an extension cord attached to the harness and to be held or worn on the wrist of the parent. This system, although effective, can limit the range that a child may be separated from the parent. The system can also be cumbersome and difficult to manage, particularly in a crowd, as the extension cord must be maneuvered around people should there be any distance between the parent and child. The extension cord may further trip those in the crowd or bring additional dangers to those in the crowd.

Several known devices trigger an alarm when two units (a detector unit and a transmitter unit) are separated by more than a preset distance. For example, one system discloses a device to deter kidnapping of a child. The system generates a signal at the transmitter unit and provides for an alarm trigger at the child unit. This and other similar systems are based on proximity or separation sensing, and may offer little added functionality, such as two-way communications, adaptive alarming or child panic provisions. The power output and hence range of a pure proximity transmitter may also be limited by regulations set forth by the Federal Communications Commission. As such, these systems do not permit for a very large proximity range, and can often be encumbered by frequent false alarms as a result. Moreover, such systems are frequently provided only with an alarm-on and alarm-off state. Accordingly, the parent is permitted little or no discretion in terms of varying proximity range or other functionalities to adapt to different environments.

There remains, therefore, a need for a spatial monitoring and security system that is convenient in use, relatively free from false alarms, functional over a relatively large range, and affords both the parent and the child the ability to page one another or issue an alarm in a panic situation.

SUMMARY OF THE INVENTION

In accordance with one embodiment, the invention provides a substantially immediate notification to the parent of the movement of a child when the child is outside a preset proximity radius (i.e., range). Furthermore, the present invention combines motion activated response with two-way wireless signaling to enable the parent to automatically screen false alarms and set the proximity radius accordingly. The invention also permits the system to be carried in the armed state without nuisance to the parent or child, and is only active when the child or parent is in motion. This provides for an effective means to manage power and extend battery life. In another embodiment, the invention uses the aforementioned combination of a motion sensor and a separation distance (i.e., proximity) sensor to reduce incidences of false alarms. In one embodiment, an audible alert or alarm will sound only if both proximity and motion sensors indicate a potential separation. The invention, in a further embodiment, provides a tamper resistant switch without need for a keyed or combination locking switch. In another embodiment, the invention provides an adaptive alarm function where the parent is given the ability to cause an audible locating beacon at selectable volume levels prior to sounding an alarm in a panic situation.

These and other embodiments of the invention will become apparent in light of the specification, claims and drawings.

The invention, in accordance with one embodiment, comprises two units, a Child Detector Unit (hereinafter "Child Unit") to be carried with or attached to the child, and a Parent Control Unit (hereinafter "Parent Unit") to be carried or controlled by the parent or guardian of the child to be protected. The system can be armed and disarmed conveniently using the Parent Unit. When armed, the Child Unit monitors the child for motion. Once motion is detected, the proximity sensor sends a signal to the Parent Unit, and determines whether the Child Unit is within a near field proximity (i.e., preset proximity range) relative to the Parent Unit. If the Child Unit is within the preset proximity range, the Parent Unit sends confirmation signal to the Child Unit to indicate that it is within the near field proximity range. If the Parent Unit is not within the near field proximity, a confirmation signal will not be sent in response to the proximity signal from the Child Unit. In the absence of the confirmation signal, if the system is in Normal Mode, an alert signal is sent from the Child Unit to the Parent Unit, which triggers a small warning alarm on the Parent Unit to alert the parent discretely. The parent may then use the Parent Unit to transmit a signal to the Child Unit, triggering an audible locating beacon or alarm of selectable volume. The alarm is designed to provide a means for locating the child and if necessary interrupt an abduction in progress.

If the system is in Automatic Mode, in the absence of the confirmation signal, the combination motion detection and proximity detection system may automatically sound an alarm at the Child Unit to prevent an attempted abduction or to alert the parent that the security of the child may be compromised. The automatic mode of operation is useful when the parent may be temporarily out of sight or range of the child and thus cannot screen for false alarms. The automatic mode can sound the alarm in an adaptive sequence that varies the alarm according to the time the child remains separated from and unlocated by the parent. It should be noted that an isolated movement of the child causes only a brief warning burst from the alarm if outside the preset proximity range from the parent. A persistent movement by the child, as would occur in an attempted abduction, on the other hand, causes the alarm to rapidly escalate to a full scale alarm. The adaptive alarm responds to an attempted abduction with a full scale alarm, yet allows the parent the opportunity to locate the child and get back within the preset range before the full scale alarm sounds.

By combining both the motion and proximity detection over a two-way wireless communication link, the Parent Unit is permitted to remain active with the Child Unit in the armed state without generating a false alarm or false alert in the Parent Unit, despite the constant motion caused by the child. This is because the parent, and therefore, the Parent Unit, should always be within the preset near field proximity of the Child Unit when the child is close to the parent. In using a combination motion and proximity system, the system of the present invention only generates alerts or alarms when motion is detected and when the child is outside of the set near field proximity. The employment of motion detection mechanism allows the system of the present invention to have a generally higher level of power emission, and hence enhanced proximity range, when compared to systems currently available on the market which employ only a proximity detection mechanism. This is because in systems which employ only a proximity detection mechanism, Federal Communications Commission (FCC) regulations permit emission of power at only certain low levels between the Parent and Child Units.

In accordance with another embodiment, if the Child Unit remains motionless and motion is detected in the Parent Unit, and the Parent Unit is not within the preset near field proximity to the Child Unit, an alarm may sound in the Child Unit or an alert signal may be issued to the Parent Unit indicating that security of the child may be compromised.

A tamper resistant power mode switch for the Child Unit provides security without the use of a locking switch to a numbered keypad. In certain applications, for example, if the Child Unit is attached externally to the ankle of the child with a locking band, the power mode switch may be exposed. In such applications, a power cutoff switch could be used by an abductor to defeat the system by simply turning the system off. In one embodiment of the invention, the power mode switch does not physically disconnect the remaining components from the power supply. Instead, the Child Unit enters a low power mode whereby it draws little current from the power supply. In effect, when in the low power mode, the amount of current drawn from the battery is substantially minimal, so as to not affect the overall shelf-life of the battery. When the power mode switch is placed in the off position, the Child Unit can only enter the low power mode if the system is first disarmed by the Parent Unit. If the Child Unit is armed when the power mode switch is placed in the off position, the Child Unit remains on and armed until the Parent Unit is used to disarm the system. Thus, when the Child Unit is armed, the exposed switch cannot be used by a would-be abductor to manually turn the system off. Convenient switch operation is retained for the parent, however, who may disarm the system using the Parent Unit before turning the system off.

BRIEF DESCRIPTION OF THE DRAWINGS

Features of the invention can be understood more readily by reference to the accompanying drawings in which.

DETAILED DESCRIPTION OF SPECIFIC EMBODIMENTS

The systems illustrated herein can include a pair of units, comprising a Child Unit and a Parent Unit. Both units can be compact and lightweight. As will be seen from the following description, the paired units provide a security system for monitoring spatial relationship between mobile objects, such as between a parent and a child, that employs two-way communications between the Parent Unit, operated by a parent or guardian, and the Child Unit, worn by the child being protected.

Figure 1:
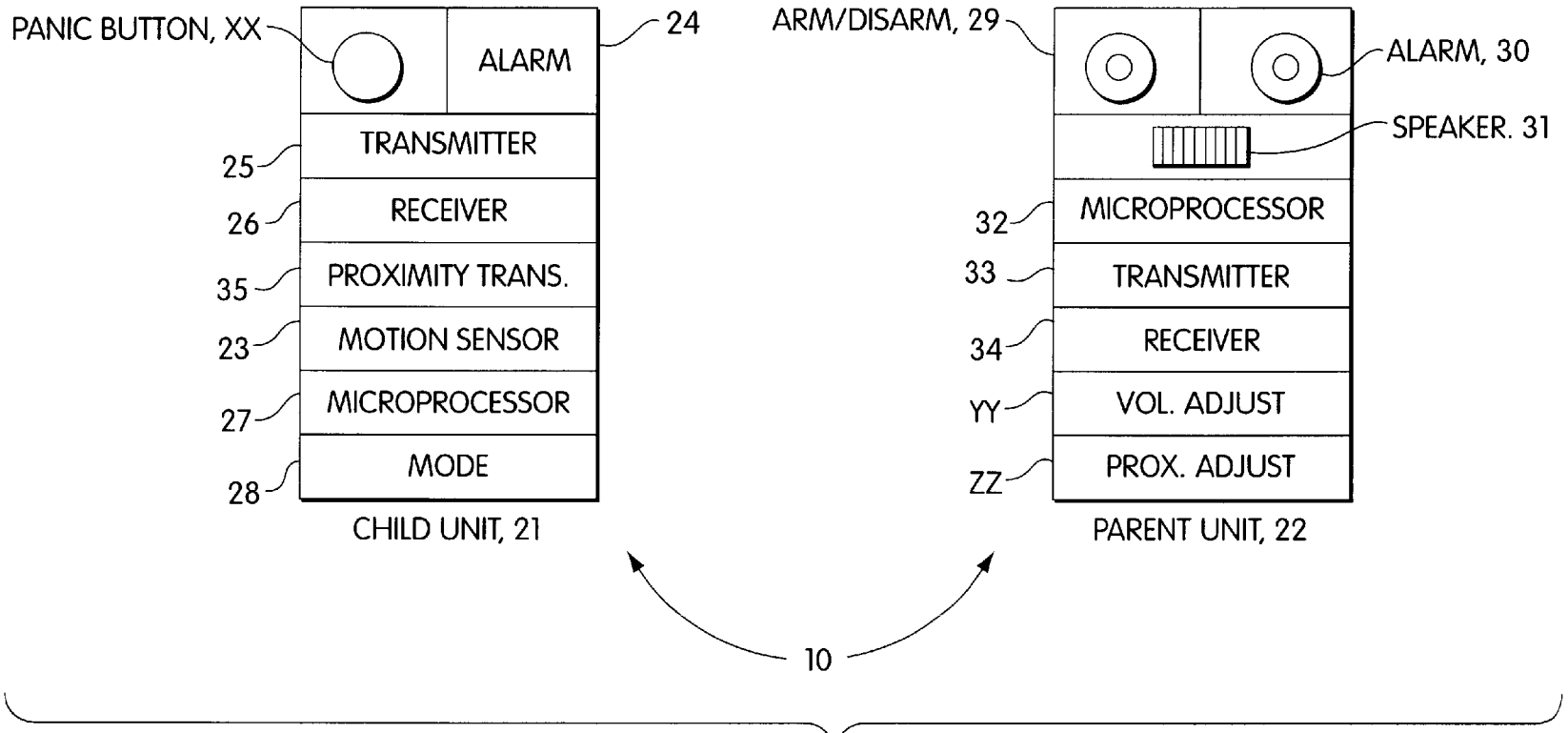
FIG. 1 illustrates major components of the Child Unit and Parent Unit in accordance with one embodiment of the invention.

FIG. 1 illustrates a system 10 for monitoring the spatial relationship between mobile objects. The system 10 includes a Child Unit 21, which can be housed on or affixed to a child, and a Parent Unit 22. The Child Unit 21 can be affixed to the child by, for example, a strap, a bracelet, a wrist band, a hook and loop fastener or other suitable mounting mechanism. The Child Unit 21, in one embodiment of the invention, can include a panic button XX, a motion sensor 23, an alarm 24, a detector transmitter 25, a detector receiver 26, a detector microprocessor 27, a mode switch 28 with position indicators, and a proximity transmitter 35. The Child Unit 21 can operate either in an automatic alarm mode (with mode switch 28 in the automatic position) or in a travel mode (with the mode switch 28 in the on position). The Parent Unit 22, in one embodiment, can include an arm/disarm button 29, an activation device depicted as an alarm button 30, a warning device depicted as alert speaker 31, a control microprocessor 32, a control transmitter 33, a control receiver 34, a volume control YY, a proximity range control ZZ, and a motion sensor (not shown). Power is supplied in each unit by batteries which have been omitted from all figures for simplicity.

The Child Unit 21, with the mode switch 28 in the on position, can detect a possible security breach when motion sensor 23 detects movement of child when the child is outside of a preset near field proximity of the Parent Unit 22. In an embodiment of the invention, the motion sensor 23 can be a dual axis accelerometer of the type employed for detecting motion along two axes, such as the ADXL 250 manufactured and sold by Analog Devices of Norwood, Mass. The accelerometer can be coupled to the microprocessor 27 for generating an interrupt that signals the microprocessor 27 that motion was detected. Alternatively, each time the motion sensor 23 detects movement, the accelerometer can set a flag in a data register that the microprocessor periodically reads, and it will be apparent to those of ordinary skill in the art that other techniques can be employed for collecting and storing information regarding detected movement. It will be father apparent to one of ordinary skill in the art that other motion detectors can be employed including single axis accelerometers, triple-axis accelerometers, rolling ball motion detectors, or any other suitable device. It should be appreciated that although motion detection is discussed in connection with the Child Unit 21, the spatial monitoring system 10 of present invention can equip the Parent Unit 22 with a motion sensor to accommodate a situation wherein the Child Unit 21 is stationary, while the Parent Unit 22 is in motion.

Once movement has been detected, the proximity transmitter 35 in the Child Unit 21 sends out a coded proximity check signal at a set near field proximity (i.e., radius) having a known pattern to the receiver 34 in the Parent Unit 22. If the Parent Unit 22 is within the near field proximity, the proximity signal will be received by the Parent Unit receiver 34. In response to the proximity check signal, a confirmation signal is sent from the Parent Unit transmitter 33 to the detector receiver 26 in the Child Unit 21, and the parent does not get notified of the movement by the child. Otherwise, if the Parent Unit 22 is not within the set radius (i.e., outside the near field proximity), the proximity signal will not be received by the Parent Unit receiver 34 and a confirmation signal from the Parent Unit transmitter 33 will not be issued.

In accordance with one embodiment of the invention, the proximity signal generated from the proximity transmitter 35 has a field strength of from about 3,500 microvolts per meter to about 10,500 microvolts per meter. With such a field strength, the generated proximity signal can have a near field proximity of from approximately 15 feet in radius to approximately 350 feet in radius. In an embodiment, the scope of the near field proximity provided by the proximity signal can be appropriately adjusted or selected, if so desired, by the proximity adjust switch ZZ to permit adaptation to a particular environment or application.

It should be appreciated that in a system employing only a proximity transmitter (i.e., a periodic transmitter), the range of the generated proximity signal is substantially less than that generated by the system 10 of the present invention. In particular, FCC regulations limit the power output, and thus the field strength, of a proximity signal generated from a periodic transmitter to about 4,100 microvolts per meter. In contrast, for an intentional transmitter, a transmitter that is intentionally triggered and of which the present system can be classified, FCC regulations permit more than a two fold increase in power output to about 10,500 microvolts per meter. In the present system 10, which employs the proximity transmitter 35 in combination with motion sensor 23, because the proximity transmitter 35 is intentionally activated only when motion is detected by the motion sensor 23, the power output of the proximity transmitter can be substantially higher, as permitted by the FCC, than that permitted in a system employing only a proximity transmitter.

In the absence of a confirmation signal from the Parent Unit transmitter 33, particularly when the Parent Unit 22 is outside the near field proximity, the Child Unit 21 notifies the parent of movement and proximity by sending, for instance, a coded radio frequency alert signal through the Child Unit transmitter 25 to Parent Unit receiver 34. The alert signal, in a preferred embodiment of the invention, is generally of a higher strength/power than the transmitted proximity check signal. The Parent Unit receiver 34, in turn, activates the alert warning device 31 of Parent Unit 22 (or equivalent vibration alert), notifying the parent that security of child may be compromised. The parent may thereafter optionally trigger the alarm 24 in the Child Unit 21 by pressing alarm button 30, which causes an alarm signal from the transmitter 33 to be sent to the Child Unit 21. If appropriate, the parent may select the desired volume of the Child Unit alarm 24 by adjusting the volume adjust switch YY in the Parent Unit 22. It should be understood that although the discussion refers to a proximity check signal originating from the Child Unit 21, such functionality may be easily adapted to originate from the Parent Unit 22. In such a situation, the measurement of proximity signal and estimation of the relative range may be accomplished by the Child Unit 21.

The transmitter 33 and receiver 34 in the Parent Unit 22, and the transmitter 25 and receiver 26 in the Child Unit 21 can be designed to transmit and receive radio frequency (R-F) signals to permit the Child Unit 21 to communicate with the Parent Unit 22, or any R-F device, In one embodiment, the transmitter and receiver in the Parent and Child Units can be formed from discrete components, including capacitors, inductors, resistors, transistors and other common elements, as well as from a combination of integrated circuits and discrete components. The design and development of such R-F front-end circuits is well known in the art of electrical engineering. Alternatively, the transmitter and receiver in each of the Parent and Child Unit can be a single transceiver unit having both transmitting and receiving capabilities. In addition to being R-F devices, other modes of communication may alternatively be used by the transmitter/receiver or transceiver in the Parent and Child Units. For example, infrared (IR) communication may be employed for IR exchange of data signals that can be representative of commands for operating the Parent and Child Units. Satellite data communication, cellular data telecommunication, modem communication, or any other wireless communication for transferring data over a communication network may also be used.

Another manner in which proximity may be determined is to employ a signal strength indicator. In this method, a proximity signal of a specific strength is first transmitted from the proximity transmitter 35 to the Parent Unit receiver 34. Depending on the distance at which the Parent Unit 22 is located relative to the Child Unit 21, an attenuated signal will be received by the Parent Unit receiver 34. The strength of the attenuated signal is then measured and compared to the strength of the original proximity signal. An estimate of the relative range between the Parent Unit 22 and the Child Unit 21 is thereafter calculated by taking the product of the measured attenuated signal and a predetermined calibration constant. A calibration constant is defined in the context of the present invention as a number which when multiplied by the signal strength yields a proximity range. For example, if the signal strength is 0.001 watts and the calibration constant at this power level is 10,000 meters per watt, then the relative range is (0.001 watts) (10,000 meters/watt), or 10 meters. If this estimated relative range is within the near field proximity, a confirmation signal will be transmitted from transmitter 33 of the Parent Unit 22 to receiver 26 of the Child Unit 21. This method of measurement, in one embodiment, uses a special detector chip (not shown) to receive and measure the strength of the proximity signal. Such a chip is preferably made available in the Parent Unit 22, but may alternatively be provided in the Child Unit 21 so that the Parent Unit may also receive and measure the signal strength for comparison. The detector chip is commercially available as model number HP-900 from Linx Technologies, Inc. located in Grants Pass, Oreg.

To conserve energy, Child Unit microprocessor 27 may be provided, in accordance with an embodiment of the invention, with timing information for use in connection with the proximity transmitter 35, so that a proximity check signal will not be transmitted for every single motion detected. Such a system is further described hereinafter.

Although a discrete proximity transmitter 35 is provided in connection with the embodiment of FIG. 1, it is contemplated that the functions of the proximity transmitter 35 and the functions of the Child Unit transmitter 25 may be incorporated into a single unit. In such an embodiment, a switch may be employed to permit this single unit to appropriately switch between the proximity signal function of the proximity transmitter 35 and the alert signal function of the detector transmitter 25.

Parent Unit 22, in FIG. 1, communicates and cooperates with Child Unit 21. The aim/disarm button 29 causes Parent Unit 22 to send a signal through Parent Unit transmitter 33, that when received by Child Unit receiver 26 causes Child Unit 21 to activate or deactivate motion sensor 23. Alarm button 30 causes Parent Unit transmitter 33 to send an alarm signal which, when detected by Child Unit receiver 26, activates alarm 24. Thus, when alert speaker 31 in the Parent Unit 22 is activated by an alert signal from Child Unit 21, the parent using the spatial monitoring security system 10 may respond (i) by pressing alarm button 30 on the Parent Unit 22 to trigger the alarm 24 on Child Unit 21, thereby startling a would-be abductor and summoning others to aid in thwarting an abduction, or (ii) by pressing the alarm button 30 with the volume adjust switch YY set to low, sounding an audible locating beacon significantly less intrusive than a full-scale alarm. By adjusting the volume adjust switch YY, the parent may select the sound output level on the Child Unit 21 and may vary the volume of the sound output from a somewhat quiet alert to a loud intrusive siren.

Figure 2:
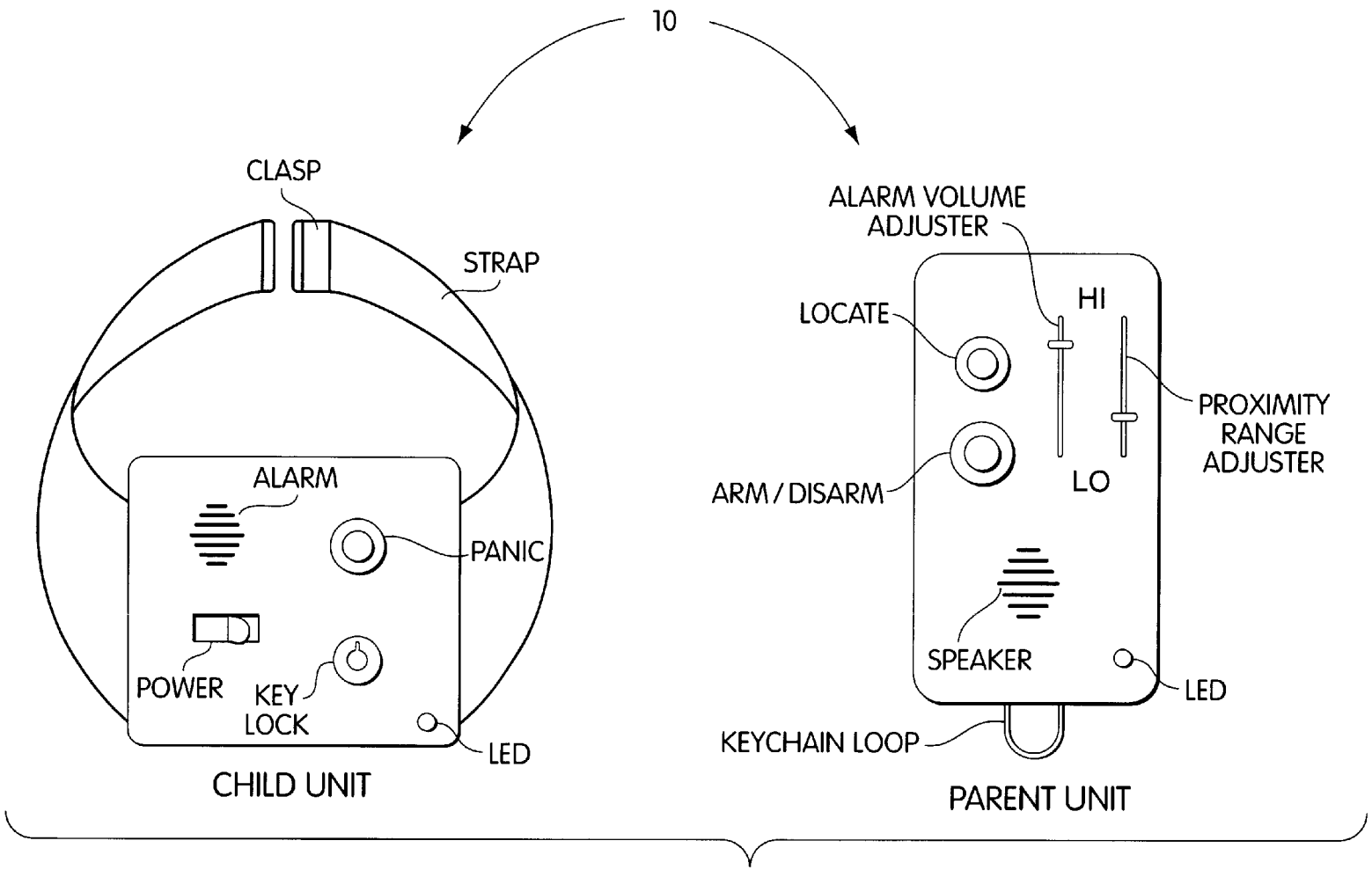
FIG. 2 illustrates one embodiment of a Child Unit and a Parent Unit employed in the spatial monitoring system of the present invention.

FIG. 2 illustrates one embodiment of the Child Unit 21 for attachment to a child. In particular, the Child Unit 21 is shown having straps which permit the Child Unit 21 to be attached to the ankle or wrist of the child. The attachment mechanism on the Child Unit 21, of course, does not necessarily have to be a strap but can be any mechanism known in the art. By attaching the Child Unit 22 to the ankle of the child or other locations, the noise generated from the alarm 24 may be kept substantially away from the child's ears. The Parent Unit 22, on the other hand, can be a small hand-held unit which, for example, can be attached to a key-chain.

Figure 3:
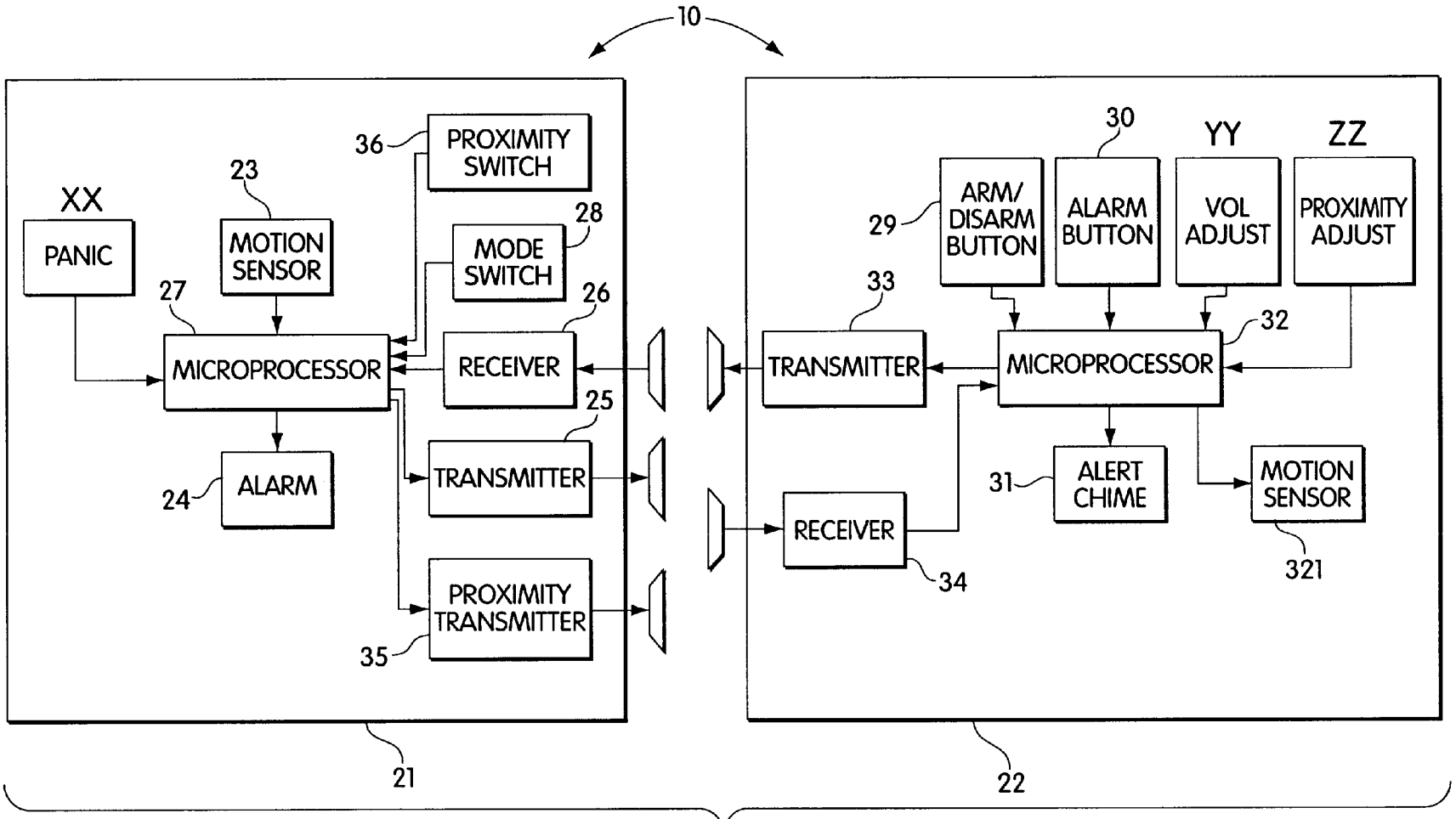
FIG. 3 schematically represents the connectivity between elements of the Child Unit and Parent Unit in the embodiment of FIG. I and the flow of information and control within and between the units.

FIG. 3 shows a schematic representation of the connectivity and interaction among and between components of Child Unit 21 and Parent Unit 22 of FIG. 1. Microprocessor 27 in the Child Unit 21 and microprocessor 32 in the Parent Unit 22 play a central role in enabling the functionality of the system 10. Microprocessors 27 and 32 are capable of performing a wide variety of calculations, making decisions, and controlling other components according to programming instructions stored in firmware which can be customized for different applications. Firmware refers to programs devised to adapt a general purpose microprocessor to a special purpose, such as in the devices disclosed herein, and which are persistently stored in memory accessible to the microprocessor.

Microprocessors 27 and 32 can track the status of the other elements of Child Unit 21 and Parent Unit 22, respectively, and perform all decision and control functions according to firmware instructions. The microprocessors further facilitate the control of fairly complex interactions between components within each unit. For instance, the Child Unit microprocessor 27 processes output from the panic button XX, motion sensor 23 and receiver 26, and controls the sounding of alarm 24 and the transmission of signals through Child Unit transmitter 25, proximity transmitter 35 and proximity switch 36. Parent Unit microprocessor 32, likewise, processes output from arm/disarm button 29, alarm button 30, volume adjust switch YY, proximity adjust switch ZZ, and receiver 34, and controls the activation of alert speaker 31 and the transmission of signals through the transmitter 33.

In addition to decision and control functions, microprocessors (27, 32) encode and decode the signals exchanged by transmitters (25, 33, 35) and receivers (26, 34), respectively, of Child Unit 21 and Parent Unit 22. Encoded signals enable the spatial monitoring security system 10 to generate a multiplicity of unique messages between units on a single frequency and create system identification so that multiple spatial monitoring security systems 10 can operate in the same vicinity without interference. Additionally, the system identification makes it difficult to defeat the spatial monitoring security system 10 by simply disarming the Child Unit 21 with a similar Parent Unit 22. For each transmitted signal, microprocessor 27 or 32 encodes a Parent-Child system identifier, which is shared by the paired Child Unit 21 and Parent Unit 22, and a signal identifier, which identifies the signal being transmitted. Similarly, when a signal is received by receiver 26 or 34, microprocessor 27 or 32 decodes the system identifier and signal identifier. Child Unit 21 and Parent Unit 22 respond only to signals that contains the pair's system identifier. Some embodiments may further encode a unit identifier with the signal whereby a family of Child Units sharing a single system identifier may be individually addressed and controlled by a single Parent Unit sharing the same system identifier but having means to select the unit identifier.

Power management is another function of microprocessors (27, 32). Commercially available microprocessors, such as the PIC 16C56 microprocessor from Microchip, located in Phoenix, Ariz., include features specifically designed to reduce power consumption, thereby prolonging battery life. In one embodiment, microprocessors (27, 32) provide power to the components they interact with in the respective units only when necessary to perform a specific function. This minimizes the energy consumed by those components. In addition, the microprocessors themselves feature a low power mode in which they consume only a very small current, typically a few micro-amperes. The power requirement is low enough in this mode that battery life is essentially unaffected by the current draw of the microprocessor connected continuously in this mode.

Microprocessors (27, 32) can be programmed to enter the low power or sleep mode whenever idle and awaken periodically, as often as several times per second, to test for control signals or other output from the components with which the respective microprocessors interact. In normal operation the time required to scan for inputs can be quite small compared to the sleep time. If no inputs are detected the system uses only a small fraction of the power required for continuous scanning for inputs. For example, in one embodiment, the microprocessor sleeps for 200 milliseconds, and the time required to test for signals and inputs may be 20 milliseconds in some active modes, reducing power requirements by approximately 90% compared to continuous powering of all components.

The spatial monitoring security system 10 has two states, armed and disarmed. A status bit in the memory of each microprocessor (27, 32) indicates the current state. The parent can change the arm/disarm state of the system 10 by depressing arm/disarm button 29 of Parent Unit 22.

When arm/disarm button 29 is pressed, control microprocessor 32 causes control transmitter 33 to send an encoded signal, arm or disarm, according to the current value of its status bit. If the Parent Unit microprocessor 32 status bit currently indicates that the system is armed, control microprocessor 32 causes transmitter 33 to send a disarming signal, or if the status bit indicates that the system is disarmed control transmitter 33 sends an arming signal.

Child Unit 21 can be configured to only enter the armed state when mode switch 28 is in the on position. When Child Unit receiver 26 receives an arming signal from Parent Unit transmitter 33, Child Unit microprocessor 27 changes its status bit to indicate that the system is armed and then causes transmitter 25 to return coded arming confirmation signal. When the arming confirmation signal is received by Parent Unit receiver 34, control microprocessor 32 sets the Parent Unit microprocessor 32 status bit to indicate the armed state.

A similar process is followed to place the spatial monitoring security system 10 in the disarmed state from the armed state. When Child Unit receiver 26 receives a disarming signal from Parent Unit transmitter 33, microprocessor 27 changes its status bit to indicate that the system is disarmed and then causes Child Unit transmitter 25 to return a coded disarming confirmation signal. When the disarming confirmation signal is received by Parent Unit receiver 34, control microprocessor 32 sets the control microprocessor 32 status bit to indicate the disarmed state.

Generally, some form of feedback acknowledging arming or disarming is reassuring to the parent or guardian. In the preferred embodiment, when its memory status bit changes state (armed or disarmed), Child Unit microprocessor 27 causes alarm 24 to produce two brief tones of changing pitch. Two successive tones of rising pitch indicate a change to the armed state, and two successive tones of falling pitch signal a change to the disarmed state. The two tone indication of the change of state at Child Unit 21 may be supplemented or replaced in some embodiments, for example, by visual indicators such as an LED or by similar indicators at Parent Unit 22.

The motion sensing operation of spatial monitoring security system 10 occurs when the system is in the armed state. In one embodiment, the Child Unit microprocessor 27 does not check for motion sensor 23 output in the disarmed state. In the armed state, Child Unit microprocessor 27 checks motion sensor 23 for output several times each second. In the embodiment associated with FIG. 1, when a predetermined period of time has elapsed, and movement is subsequently detected by motion sensor 23, with a proximity switch 36 activated, the proximity transmitter 35 issues a proximity check signal to the receiver 34 in the Parent Unit 22. If the relative position of the Parent Unit 22 to the Child Unit 21 is not within the near field proximity or if the child possessing the Child Unit 21 is subsequently moved out of the near field proximity, the Child Unit transmitter 25 sends an alert signal to the Parent Unit receiver 34. In response to the alert signal, the alert speaker 31 notifies the parent that the child has moved out of the near field proximity. Such a motion sensing process can be similarly adapted for application in the Parent Unit 22 when the Parent Unit 22 is provided with a motion sensor 321.

Having been alerted by alert speaker 31, the parent ascertains the cause of the alert and may activate alarm 24 in Child Unit 21 by depressing alarm button 30 while setting the volume adjust switch YY thereby prompting Parent Unit microprocessor 32 to cause Parent Unit transmitter 33 to send an alarm signal with selectable volume to Child Unit receiver 26. When Child Unit microprocessor 21 determines that receiver 26 has detected the alarm signal, it continuously activates alarm 24 until a second alarm signal is received by Child Unit receiver 26, or in the case of a low volume setting on the volume adjust switch, a burst of audible chirps. Some embodiments may additionally limit the duration of alarm 24 activation with a timer.

The transmission of an alert signal to Parent Unit 22 is a response that the Child Unit microprocessor 27 may initiate when motion is detected in the Child Unit 21, and in response to a proximity check signal, a confirmation signal from the Parent Unit 22 is not returned. Alarm 24, in the travel mode, cannot be activated except by the parent or by the child panic button XX, so the system cannot initiate a false alarm. In a situation where the child requires the immediate attention of the parent, the child can directly access the panic button XX, for example, by pressing it, to sound a distinctive signal to notify the nearby parent that the child is in need of attention.

A second benefit of sending an alert signal to Parent Unit 22 when Child Unit 21 senses movement without proximity, is that alert spewer 31 can provide a low level of intrusion. The parent can carry the system armed without generating any loud false alarms.

Child Unit microprocessor 27 uses timing information derived from its clock function to determine if output from motion sensor 23 should activate the issuance of a proximity check signal.

Figure 4:
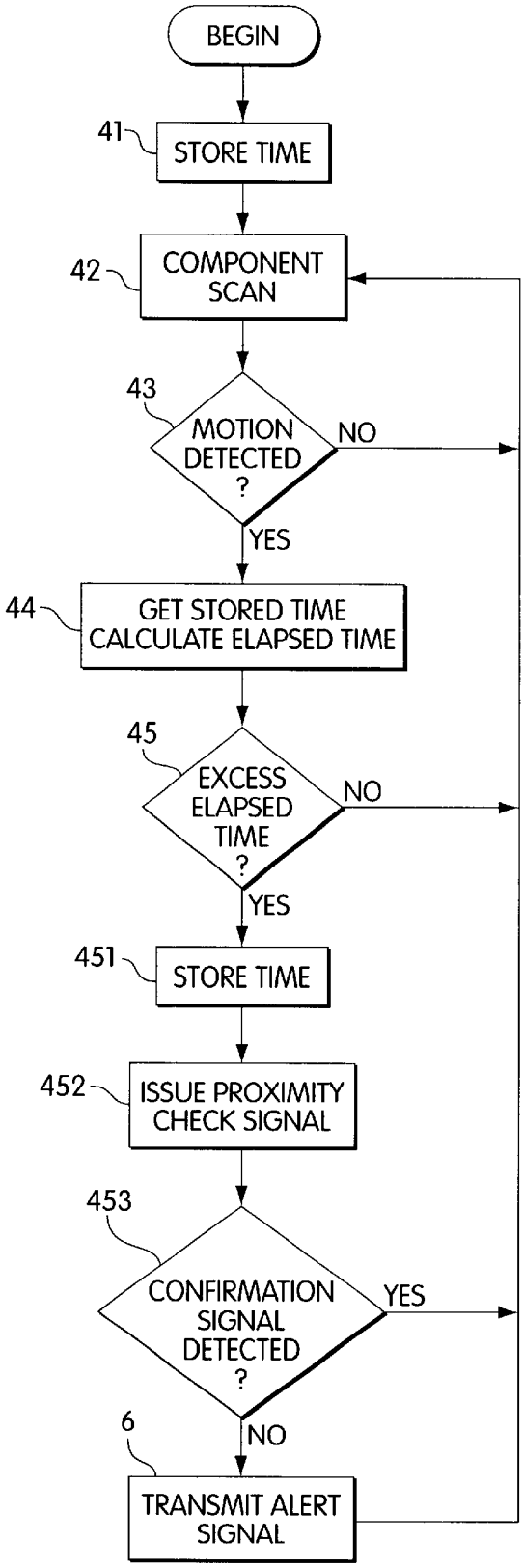
FIG. 4 is a simplified flow chart illustrating proximity and alert signal generation logic used by the Child Unit and Parent Unit in the normal mode of operation.

FIG. 4 illustrates the control logic embodiment for use in activating a proximity check signal in response to a detected movement either in the Child Unit 21 or the Parent Unit 22. In the embodiment shown in FIG. 4, when the system is first armed, the internal clock function is reset to $T_o$ in step 41. It should be noted that for ease of discussion reference is now made to the Child Unit 21, with the understanding that the components hereinafter discloses are similarly applicable to the Parent Unit 22. The Child Unit microprocessor 27 then initiates a component scan in step 42. After step 42 is completed, Child Unit microprocessor 27 checks for movement in step 43. If movement is detected in step 43, Child Unit microprocessor 27 calculates an elapsed time in step 44 in relation to $T_o$. If the elapsed timed in step 45 does not exceed the predetermined period, the Child Unit microprocessor 27 returns to step 42. If the elapsed time in step 45 exceeds the predetermined period, the internal clock function is reset to $T_o$ in step 451. This new reset $T_o$ is used to calculate a subsequent elapsed time. Once the internal clock function is reset to $T_o$, a proximity check signal is issued in step 452 by proximity transmitter 35. In response to the proximity check signal, the Child Unit receiver 26 checks for a confirmation signal in step 453 from the Parent Unit transmitter 33. If a confirmation signal is received, the Child Unit microprocessor 27 returns to step 42. If a confirmation signal is not received, by the Child Unit receiver 26, an alert signal is transmitted in step 46 from the Child Unit transmitter 25 to the Parent Unit receiver 34.

With the control logic of FIG. 4, if the Child Unit 21, based on the reset $T_o$ (i.e., arming time from which an elapsed time may be later calculated) in step 41, is armed for more than a predetermined period, for instance, three seconds, after which an initial movement is detected, a proximity check signal may be issued. However, before the proximity check signal is issued in response to this initial movement, a new $T_o$ is reset in step 451. The new reset time $T_o$ is important, as it is used to calculate all subsequent elapsed time. Thus, if the initial movement ceases before the elapsed period, the detector microprocessor 27 returns to step 42 and the next movement is calculated based on the new reset $T_o$ in step 451. If movement, on the other hand, continues to be detected, a proximity check signal will be transmitted after the elapsed time has expired, in reference to time-zero stored in step 451. A proximity check signal will continue to be sent out for example, every three seconds, until movement is ceased, at which time the control logic returns to step 41.

Still another feature of the invention is the tamper resistant power mode switch 28. In some applications the invention mode switch 28 may be visible and accessible, for example, if the housing of Child Unit 21 is externally attached to an article of clothing. The tamper resistant switch prevents a abductor from using the switch to deactivate Child Unit 21 when it is armed, yet still allows the parent to conveniently place Child Unit 21 in its low power mode to conserve battery life when not in use.

As noted earlier, Child Unit microprocessor 27 has power management features that make it capable of substantially stopping current flow from the battery. In one embodiment, Child Unit microprocessor 27 is always connected to the battery. Mode switch 28 is connected such that detector microprocessor 27 can check to determine which position it is in, but mode switch 28 cannot interrupt power to detector microprocessor 27.

Child Unit 21 has a low power mode of operation that it enters when it is disarmed and mode switch 28 is placed in the off position. Child Unit 21 can only enter the low power mode from its disarmed state. In low power mode, Child Unit microprocessor 27 awakens from its periodic sleep mode using its power management features, as described earlier, and checks only for a change in mode switch 28 position. Child Unit microprocessor 27 requires a few microseconds to perform this check, which is less than 0.01% of the 200 millisecond sleep period used in the embodiment described above. The power requirement is so small in low power mode that battery life is largely unaffected by the absence of a power cutoff switch.

When mode switch 28 is in the on position and Child unit 21 is armed, microprocessor 27 does not check the position of mode switch 28. If the position of mode switch 28 is changed while Child Unit 21 is armed, microprocessor 27 does not process the change in switch position, and Child Unit 21 remains armed.

Since Child Unit 21 cannot enter the low power mode from the armed state, an abductor cannot use mode switch 28 to deactivate the system. On the other hand, the parent may place Child Unit 21 in its low power mode by disarming the system using Parent Unit 22 before (or after) placing mode switch 28 in its off position. Possession of Parent Unit 22 is necessary to place Child Unit 21 in its low power mode. The tamper resistant function of mode switch 28 prevents the system from being placed in low power mode by anyone other than the parent, yet does not require keys or a combination to prevent unauthorized deactivation.

A second active detection mode may be selected by placing mode switch 28 in the automatic position. In this mode, Child Unit 21 triggers alarm 24 automatically, rather than sending an alert signal to Parent Unit 22, when motion sensor 23 detects motion and there is an absence of a confirmation signal in response to a proximity check signal.

In automatic mode, Child Unit 21 may be armed and disarmed just as in alarm screening mode, using Parent Unit 22 to send arming and disarming signals. Mode switch 28 retains its tamper resistance because Child Unit microprocessor 27 does not check for a change in switch position while Child Unit 21 is armed. Child Unit 21 must be disarmed to effect a mode change.

With the adaptive alarm, Child Unit microprocessor 27 triggers alarm 24 using a sequence of alarm patterns in succession if motion sensor 23 continues to detect movement in absence of a confirmation signal from the Parent Unit 22. The alarm patterns range from a warning sound at the lowest level of the sequence to a full scale alarm of several seconds duration at the highest level of the sequence.

In a preferred embodiment, five alarm levels are defined. The lowest level alarm is a single brief burst from alarm 24 followed by a pause; the second level is two brief bursts in rapid succession followed by a pause, and so on through four levels. Each alarm pattern through level four has a total duration of one second, including the pause which is adjusted in length to create the one second total duration. Level five is a full scale alarm of five seconds duration beyond the last detected movement. Other embodiments may vary pitch and/or volume at each level in addition to or instead of pulsing the alarm, and timing and number of levels also may be different.

Child Unit microprocessor 27 tracks the alarm level and sounds the alarm pattern that corresponds to the current alarm level when motion is detected in the absence of proximity to the Parent Unit. The alarm level is increased each time the alarm is sounded in response to motion sensor 23 output until the alarm level reaches its highest value. Each lower level alarm pattern is allowed to finish before motion sensor 23 is checked again, so a minimum of four seconds is required to reach the highest level alarm. Once at the highest level alarm, motion sensor 23 is checked continuously and the alarm timer is reset each time motion is detected. At the highest alarm level the alarm always continues to sound for a full five seconds beyond the last detected motion.

In the automatic mode, alarm 24 sounds automatically when the motion sensor 23 detects motion and there is an absence of a confirmation signal from the Parent Unit 22, and always discontinues sounding when the current alarm pattern is complete unless further motion is detected in the absence of detected proximity to the Parent Unit. Once the Parent Unit 22 has been brought to within the near field proximity, the alarm 24 is automatically silenced.

The present invention also contemplates an embodiment wherein a proximity transmitter 35 is used without the use of a motion sensor 23. In such an embodiment (not shown), a proximity check signal may be generated having a known signal pattern to generate a near field proximity. In a preferred embodiment, the proximity signal may be generated according to a timing pattern. If the Parent Unit 22 is within the proximity range, the proximity signal will be received and a confirmation is transmitted to the Child Unit receiver 26. Because a confirmation is received by the Child Unit 21, an alert signal will not be transmitted to the Parent Unit 22 to notify the parent that the distance between the Parent Unit 22 and the Child Unit is beyond the near field proximity. If, on the other hand, the Parent Unit 22 is outside the proximity range, a confirmation signal will not be returned from the Parent Unit transmitter to the Child Unit 26. In the absence of the confirmation signal, an alert signal from the Child Unit transmitter 25 is transmitted to the Parent Unit receiver 34. The alert speaker 31 is thereafter activated by the receipt of the alert signal to notify the owner that the distance between the Parent Unit 22 and the Child Unit is greater than the near field proximity. If the Child Unit in this embodiment is set on automatic mode, once the Parent Unit 22 is moved beyond the near field proximity and a confirmation signal is not returned from the Parent Unit 22 to the Child Unit, the alarm 24 may be set to sound automatically. The alarm 24 may be shut off automatically when the parent returns to within the near field proximity or when the parent actively deactivates the alarm using the Parent Unit 22.

The embodiment just described clearly accomplishes the objectives of the invention. A number of variations can easily be envisioned. For example, some embodiments may include only one of the alarm functions described herein.

Other variations adapt the system for convenient protection of children or animals. One such variation houses the invention as an integral part of an article of clothing worn by the child (or animal) being protected or monitored. For example, in one such variation the Child Unit is built into a shoe or belt. In another variation of this type, the Child Unit can be packaged as a backpack or ankle bracelet. In an application for an pet, a system can be provided whereby a proximity radius is defined by a Parent Unit, and when the animal, wearing the equivalent of a Child Unit, wanders outside this selectable radius either an alert is sounded or a low level shock is imparted to the animal thereby reminding the animal to remain within the confines of the radius.

In addition, the embodiment combining the use of a motion sensor and a proximity sensor may be adapted so that the Parent Unit may be affixed to, for example, a home wall, such that when the child, to which the Child Unit is attached is removed from the home, an alarm is sounded. Similarly, a wall unit could be used for the application to animals, whereby a low level shock or alarm is activated when the animal strays beyond the selectable radius from the wall unit. The Parent Unit or Child Unit may also include components necessary for linking to conventional communication systems, for example, cell phones, satellite paging systems, or other wireless notification systems known in the industry, to notify the parent of a abduction attempt or stray child.

Those skilled in the art will know or be able to ascertain using no more than routine experimentation, many equivalents to the embodiments and practices described herein. For example, the Parent Unit can be housed in a manner convenient to be carried by the parent and the Parent Unit housing may include a provision to be carried in a pocket, attached to a key ring, strapped to the wrist, hung on a necklace, or clipped, pinned, or tied to a belt, belt loop, lapel, watchband, or other article of clothing. The Child Unit housing may include a similar range of options for being carried with or attached to the child and may further include options to house the Child Unit as an integral part of clothing or apparel to be worn by the child.

A further additional feature provides the Parent Unit with a panic button which when depressed causes the Child Unit alarm sound as a call for aid.

Accordingly, it will be understood that the invention is not to be limited to the embodiments disclosed herein, but is to be understood from the following claims, which are to be interpreted as broadly as allowed under the law.

We claim:

1. A system for monitoring a spatial relationship between mobile objects, the system comprising:

(a) a parent unit having:

a first transceiver capable of transmitting and receiving data signals;

a proximity range adjuster coupled to the transceiver to permit adjustment of an approximate near field proximity between the objects; and an activation element coupled to the transceiver and capable of directing the transceiver to transmit an alarm signal representative of a command to activate an alarm; and (b) a child unit having:

a motion detector for generating a movement signal in response to a detected movement;

a proximity transmitter coupled to the motion detector for transmitting, in response to the detected movement, a proximity signal having said known approximate near field proximity, to the first transceiver in the parent unit;

an alarm; and a second transceiver coupled to the motion detector and the alarm for providing bi-directional transfer of data signals, the second transceiver, in the absence of a confirmation signal from the first transceiver to indicate that the parent unit is within the near field proximity, being capable of:

(A) in a first mode, automatically activating the alarm to indicate that object to which the child unit is coupled has moved outside the near field proximity, or (B) in a second mode, (i) transmitting to the first transceiver an alert signal in response to the movement signal, and (ii) activating the alarm in response to the alarm signal received from the first transceiver, which alarm signal may be generated by a user triggering the activation element of the parent unit in response to the alert signal, to indicate that near field proximity between the objects has been compromised.

2. A system as set forth in claim 1, further including a mode switch to selectively provide the system with either the first mode of alarming or the second mode of alarming.

3. A system as set forth in claim 1, wherein the parent unit further includes a motion detector for generating a movement signal in response to a detected motion by the parent unit while the child unit is stationary, so as to subsequently generate an alert signal in the parent unit to notify the parent unit that it has moved beyond the approximate near field proximity.

4. A system as set forth in claim 1, wherein the parent unit further includes an alarm volume adjuster to permit the volume generated by the alarm to be varied.

5. A system as set forth in claim 1, wherein the parent unit further includes a warning device coupled to the first transceiver, the warning device capable of being activated in response to the alert signal from the first transceiver to indicate to a user that the near field proximity has been breached.

6. A system as set forth in claim 1, wherein the child unit includes a panic button to permit a substantially immediate sounding of the alarm to notify that the object to which the child unit is attached is in need of attention.

7. A system as set forth in claim 1, wherein the second transceiver includes a transmitter component separate and distinct from a receiver component.

8. A system as set forth in claim 7, wherein the transmitter component of the second transceiver and the proximity transmitter are incorporated into a single unit that is capable of switching between functions.

9. A system as set forth in claim 1, further including a timing device for measuring a predetermined period of time between detected movements before a proximity signal is transmitted.

10. A system as set forth in claim 1, further including system for measuring comparing the strength of the proximity signal sent from the proximity transmitter to strength of the proximity signal received by the first transceiver to determine the ether the parent unit and the child unit are within the near field proximity.

11. A method to remotely monitor the security of an object, the method comprising:

providing the object with (a) a remote unit having a proximity adjuster and (b) a child unit attached to the object, the child unit having a motion detector, a proximity transmitter, and an alarm;

adjusting a near field proximity generated by the proximity transmitter;

detecting whether there is a movement of the object using the motion detector;

in response to the movement, determining whether the object is within a near field proximity of the remote unit using the proximity transmitter; and in the absence of a confirmation signal from the remote unit to indicate that the object is within the near field proximity of the remote unit, causing the alarm to generate a signal to indicate that the object has moved beyond the near field proximity.

12. A method as set forth in claim 11, wherein the step of determining further includes the steps of:

determining a distance separating the remote unit from the attached unit; and comparing that distance to the near field proximity.

13. A method as set forth in claim 11, wherein the step of determining further includes the steps of:

measuring a proximity signal strength received by the remote unit;

comparing the received proximity signal strength to a transmitted proximity signal strength from the proximity transmitter;

calculating a range between the proximity transmitter and the remote unit; and comparing the range calculated to the set near field proximity.

14. A method as set forth in claim 11, wherein the step of causing the alarm to generate a signal further includes the steps of:

sending an alert signal directed to the remote unit; and in response to the alert signal, transmitting from the remote unit a signal to the alarm, so as to generate an audio signal to indicate that the object has moved beyond the near field proximity.

15. A method as set forth in claim 11, wherein the step of causing the alarm to generate a signal further includes the step of:

triggering a pattern of audio signals wherein the pattern acts as beacon to permit location of the object.

16. A spatial monitoring system comprising:

(a) a parent unit having:

a first transceiver capable of transmitting and receiving data signals;

a first motion detector coupled to the transceiver for generating a movement signal in response to a detected motion in the parent unit;

an activation element coupled to the first transceiver and capable of directing the first transceiver to transmit an alarm signal representative of a command to activate an alarm; and (b) a child unit having:

a second motion detector for generating a movement signal in response to a detected motion in the child unit;

a proximity transmitter coupled to the second motion detector for transmitting a proximity signal having a near field proximity to the first transceiver in response to the motion detected in the child unit;

an alarm; and a second transceiver coupled to the proximity transmitter and the alarm for providing bi-directional transfer of data signals, the second transceiver, in the absence of a confirmation signal from the first transceiver to indicate that the parent unit is within the near field proximity, being capable of (i) transmitting to the first transceiver an alert signal to indicate to a user that the parent unit is no longer within the near field proximity, and (ii) activating the alarm in response to the alarm signal received from the first transceiver, which alarm signal may be generated by a user triggering the activation element of the parent unit in response to the alert signal.

17. A system as set forth in claim 16, wherein the second transceiver includes a transmitter component separate and distinct from a receiver component.

18. A system as set forth in claim 17, wherein the transmitter is an RF transmitter and the receiver is an RF receiver.

19. A system as set forth in claim 17, wherein the transmitter component of the second transceiver and the proximity transmitter are incorporated into a single unit that is capable of switching between functions.

20. A system as set forth in claim 16, wherein the parent unit includes a proximity range adjuster coupled to the first transceiver to permit adjustment of an approximate near field proximity between the parent unit and the child unit.

21. A system as set forth in claim 16, wherein the parent unit includes an alarm volume adjuster to permit the volume generated by the alarm to be varied.

22. A system as set forth in claim 16, further including, at least in the parent unit, a device for measuring and comparing the strength of the proximity signal sent from the proximity transmitter to the strength of the proximity signal received by the first transceiver to determine whether the parent unit and the child unit are within the near field proximity.

23. A system as set forth in claim 16, wherein the parent unit further includes a system identifier for generating a system identification signal representative of a parent unit and at least one child unit.

24. A system as set forth in claim 16, wherein the parent unit further includes a warning device coupled to the first transceiver, the warning device capable of being activated in response to an alert signal from the first transceiver to warn a user that the near field proximity between the parent unit and the child unit has been compromised.

25. A system as set forth in claim 16, further including a mode switch for selectively entering a low power mode for reducing power consumption.

26. A method for remotely providing security to an object being monitored, the method comprising:

providing the object with (a) a remote unit and (b) a child unit attached to the object and having a proximity transmitter and an alarm;

detecting whether there is movement in either the remote unit or the child unit;

determining whether the object is within a near field proximity relative to the remote unit using the proximity transmitter; and in the absence of a confirmation signal from the remote unit indicating that the object is within the near field proximity to the remote unit, causing an alert signal to be directed to the remote unit; and transmitting a signal from the remote unit to the alarm, so as to generate a signal to indicate the object is no longer within the near field proximity to the remote unit.

27. A method as set forth in claim 26, wherein the step of determining further includes the steps of:

setting a near field proximity within which the remote unit and the child unit should remain relative to one another, determining a distance separating the remote unit from the child unit; and comparing that distance to the near field proximity.

28. A method as set forth in claim 26, wherein the step of determining further includes the steps of:

measuring a proximity signal strength received by the remote unit;

comparing the received proximity signal strength to a transmitted proximity signal strength from the proximity transmitter;

calculating a range between the proximity transmitter and the remote unit; and comparing the range calculated to the near field proximity.

29. A method as set forth in claim 26, wherein the step of causing the alarm to generate a signal further includes the step of:

triggering a pattern of audio signals wherein the pattern acts as beacon to permit location of the object.

* * * * *